United States Patent [19]

O'Toole

[11] 4,005,678

[45] Feb. 1, 1977

[54] COATING AND STAINING MATERIAL COLLECTING DEVICE

[75] Inventor: Joseph J. O'Toole, Staten Island, N.Y.

[73] Assignee: Lawrence Peska Associates, Inc., New York, N.Y. ; a part interest

[22] Filed: June 4, 1976

[21] Appl. No.: 692,804

[52] U.S. Cl. ..... 118/505

[51] Int. Cl.[2] ..... B05C 11/00

[58] Field of Search ..... 118/504, 505, 301; 427/272, 282; 15/257 R

[56] References Cited

UNITED STATES PATENTS

| | | | |
|---|---|---|---|
| 2,332,579 | 10/1943 | Kirby | 118/505 |
| 2,693,785 | 11/1954 | West, Jr. | 118/505 |
| 2,698,002 | 12/1954 | Thoss | 118/504 |
| 2,765,770 | 10/1956 | West, Jr. | 118/505 |
| 2,889,804 | 6/1959 | Dim et al. | 118/504 |
| 3,039,433 | 6/1962 | Kormuth | 118/505 |
| 3,380,435 | 4/1968 | Wagner | 118/505 |
| 3,528,388 | 9/1970 | McLain | 118/504 |
| 3,565,038 | 2/1971 | Van Barriger | 118/504 |
| 3,788,274 | 1/1974 | McNaughton et al. | 118/504 |
| 3,872,549 | 3/1975 | Elyca | 118/505 X |

*Primary Examiner*—Morris Kaplan

[57] ABSTRACT

An elongated trough has a vertical wall element along the longitudinal axis thereof. A plurality of tapered tabs extend upwardly from the uppermost edge of the vertical wall for use as locating and retaining devices to position the stain and coating material collecting trough against a vertical surface below the horizontal lowermost edge of a flight of shingles or other wall covering materials. The tabs have holes to support the apparatus utilizing nails passing therethrough. A plurality of downwardly turned hook elements whose uppermost portions extend above the uppermost edge of the vertical wall element, may be used in conjunction with nails to also provide a mounting means for the trough which is semi-flexible in nature and adapted with a pair of caps on each end. One or more ledge traps divide the troughs into compartments so as to provide support to the frontmost surfaces of the trough and to prevent collected materials from being spread along the entire length of the inside surface of the trough.

5 Claims, 3 Drawing Figures

COATING AND STAINING MATERIAL COLLECTING DEVICE

BACKGROUND OF THE INVENTION

1. The Field of the Invention

This invention relates to fluid collecting devices and more particularly to that class applicable to fluids escaping inadvertently downwards along a vertical surface.

2. Description of the Prior Art

The prior art abounds with paint shields and splash guards for the preventing of splattering and the collecting and catching of coating materials. U.S. Pat. No. 3,528,388 issued on Sept. 15, 1970 to B. P. McLain teaches a portable hand-held paint shield whose paint catching and anti-splattering tray-like receptacle body has an elongated trough-like shape.

U.S. Pat. No. 3,538,532 issued on Nov. 10, 1970 to J. P. Shortino et al discloses a soluble convoluted shield-like assembly for attachment to a hand-held paint roller. One convolution protects the user and the surrounding area from inadvertent splashes due to the application of the paint roller on a surface to be painted. The other convolution comprises a paint retaining trough whose width exceeds that of the paint roller, serving as a supplemental splash guard and drip guard.

The McLain and Shortino patents collect paint and other surface coating materials by transporting between various areas of use, resulting in fatigue and the consequent hesitation to effectively and continually employ the apparatus for the intended purpose.

U.S. Pat. No. 2,693,785 issued on Nov. 9, 1954 to E. H. West Jr. teaches a hand-held collection box utilizing a pair of open ended troughs, whose discharge mouth portion extends over the collecting box and whose wall surfaces are positioned adjacent the lowermost edge of a flight of shingles. Each trough slopes downward so as to direct coating materials, caught thereby toward the collecting box. This invention, though covering a great length along a shingle flight line is tedious to use due to its excessive weight and difficulty of manual positioning ability each time the apparatus is to be relocated below a vertical surface in preparation to the painting or otherwise coating thereof.

SUMMARY OF THE INVENTION

A primary object of the present invention is to provide a fluid stain or paint collecting apparatus that may be conveniently hung, on a temporary basis, directly beneath the lowermost edge of a shingle flight, ship-lap siding or conventional siding, utilized as the exterior covering for a structure.

Another object of the present invention is to provide a device which need not be hand-held whilst providing an extended length of drip catching capability when in use.

Still another object of the present invention is to provide a trough-like drip catching apparatus which is flexible in nature so as to facilitate the ease of installation and removal on a vertical surface.

Yet another object of the present invention is to provide a compartmentalized longitudinal trough, thereby limiting the ability of the material captured therein to spread along the entire length of the trough, thus creating a more extensive clean-up problem and a handling problem which is heightened due to the captured material tipping the trough when moving the trough from place to place.

Many siding materials are treated with low viscosity stains as well as paste-like water base paints having the tendency to run and drip or fall in glob-like droplets respectively. The stain material when applied over otherwise unprotected casements, door frames or brick facings tends to irrevocably stain them. Paint, though more readily removed during the clean-up process, represents a nuisance which increases in intensity the longer the unwanted paint is allowed to stand and dry on the unprotected areas of the structure. The present invention utilizes an elongated compartmentalized trough having a vertical rearmost wall intended for abuttment with the vertical surface to stained or painted and to be positioned below an area operated upon at a point where the uppermost edge of the vertical surface fall neatly below the lowermost horizontal edge defining a flight or course of wall covering material, such as shingles. The plurality of tapered tabs extending upwardly from the uppermost edge of the rearmost vertical wall of the instant invention may be inserted between shingles so as to minimally locate the rearmost vertical wall inwardly beyond the frontmost lowermost edge of the lowest flight of shingles to be stained or painted. The trough extends outwardly therefrom, a sufficient distance, to insure a substantial fluid capacity for the trough and a drip-catching area well in excess of the area in which such drippings might be prevalent. Additional support elements include a plurality of hook-like fingers extending upwardly from the uppermost edge of the rearmost vertical wall which, like openings in the tapered tabs, may utilize nails to temporarily secure the apparatus at its desired location. The material comprising the trough may be fabricated from plastic or other semi-flexible material so as to allow the trough to conform to imperfect horizontal lowermost flight defining lines and to facilitate the tapered tab by tapered tab sequential installation between adjacent shingle flights. Compartmentalization of the trough limits the ability for excessive amounts of captured liquid to build up at one end of the trough, thereby limiting the ability of the trough to tip when being removed and relocated to another location, and to minimize the clean-up problems encountered when the use of the trough is terminated.

DESCRIPTION OF THE PREFERRED EMBODIMENT

The structure and method of fabrication of the present invention is applicable to a plastic or other semi-rigid material forming an elongated trough. In cross-section, one wall of the trough comprises a vertical element whose outermost surface describes a straight line. A semi-circular portion extends from the bottom of the vertical straight line portion so as to include a mouth portion upwardly turned and having a width of some 3 inches. The length of the trough has been found to be effective at seventy-two inches for protecting wide subtending structural areas to be protected. The ends of the trough are capped with quarter-round plates and the interior portions of the trough are divided into two or more compartments utilizing gussets, whose height is less than that of the end caps, installed along the length of the trough and in the interior lowermost portions thereof. The marginal edges of the gussets, exclusive of the uppermost marginal edge are secured to the interior walls of the trough, thus providing watertight adjacent compartments. A plurality of tapered tabs are fixedly secured to the uppermost vertical wall of the trough, in spaced apart relationship, so as to have the thickest portion thereof adjacent the uppermost edge of the vertical wall and the narrowest-moat leading edge of the tabs extending parallel to and outermost from the uppermost edge of the vertical wall of the trough. Each tab may be provided with a hole passing through the lateral surfaces thereof, which may be utilized to fasten the tab, previously inserted between flights of adjacent shingles, with the use of nails to the shingle structure, if desired. The tabs may be fabricated from the same semi-rigid material as the trough, or if desired, from a rigid material such as aluminum. A plurality of hook-like elements, fabricated from wire rods, are secured to the interior vertical surface of the trough, extending upwardly from the uppermost edge thereof and having the free ends bent downwardly, disposed intermediate the uppermost portion of the hook-like elements and the uppermost edge of the vertical surface. Nails may be utilized to support the hook-like elements vertically when attached through the eye portions thereof to the shingles therebehind.

Figure 1:
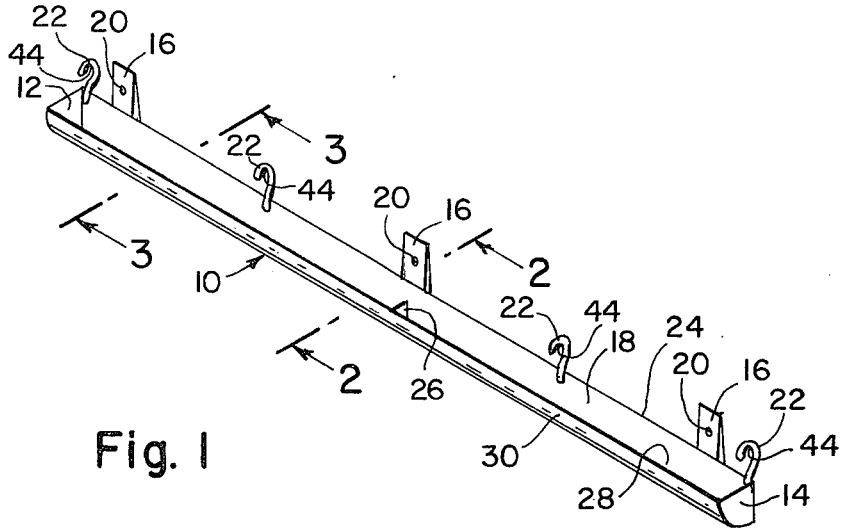
FIG. 1 is a perspective view of the present invention.

Now referring to the Figures and more particularly to the embodiment illustrated in FIG. 1 showing the elongated trough 10, having quarter round caps 12 and 14 affixed to the ends thereof. Tapered tabs 16 extend upwardly from the rearmost vertical wall 18, and are provided with holes 20, passing through the lateral surfaces thereof. A plurality of hook-like elements 22 extend upwardly from the uppermost edge 24 of the rearmost vertical wall 18. Though hook-like elements 22 are shown located at diverse positions from tapered tabs 16 in FIG. 1, they may be located directly in front of each tapered tab 16 so as to have the lowermost internal arc 44 of the hook-like uppermost end correspond with hole 20. Gusset 26 separates the floor portion 28 of the trough into two isolated areas as well as a portion of rearmost vertical wall 18 and frontmost semi-circular wall 30.

Figure 2:
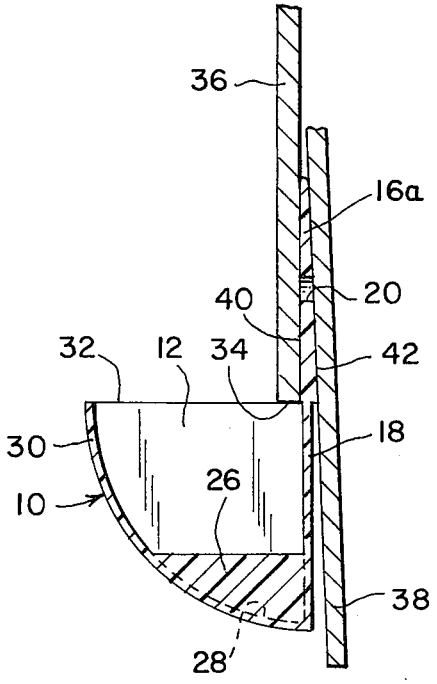
FIG. 2 is a side elevation cross-sectional view taken at lines 2—2, viewed in the direction of arrows 2—2 as shown in FIG. 1 and including the cross-sectional view of shingles in adjacent flights to which the instant invention is installed.

FIG. 2 illustrates trough element 10, in cross-section having gusset element 26 attached to the innermost surface of semi-circular wall 30 and rearmost vertical wall 18. Line 32 represents the open-mouth portion of trough 10, shown positioned below the lowermost edge 34 of shingle 36, shown partially covering rearmost and lowermost shingle 38. Tapered tab **16*a* is illustrated installed between shingles 36 and 38 so as to position hole 20 there-in-between. A nail, or other fastener, may be driven in a horizontal direction so as to at least pierce shingle 36 and hole 20, thereby providing additional vertical support to the frictional forces applied by shingles 36 and 38 to the faces 40 and 42 respectively, of tapered tab 16*a***, so as to support the trough.

Figure 3:
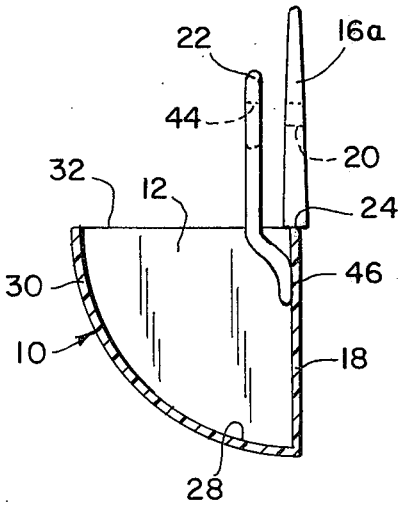
FIG. 3 is a side elevation cross-sectional view taken at lines 3—3, viewed in the direction of arrows 3—3 as shown in FIG. 1.

FIG. 3 illustrates curved section 30 and straight vertical element 18 to which is affixed tapered tab element **16*a*, having hole 20 passing therethrough. Hook-like element 22 is secured to the interior surface of vertical element 18 at point 46. Interior lowermost arc 44 is shown positioned at the same height level as the uppermost boundary of hole 20 for the embodiment in which the hook-like element 22 is fastened to vertical wall 18 in an interior area in front of a tapered tab 16*a*. In the embodiment in which the hook-like elements are disposed intermediate and adjacent the tapered tabs, lowermost arc 44 may be disposed at any desired height above uppermost edge 24**.

One of the advantages of the present invention is a fluid or paint collecting apparatus that may be conveniently hung, on a temporary basis, directly beneath the lowermost edge of a shingle flight, ship-lap siding or conventional siding, utilized as the exterior covering for a structure.

Another advantage of the present invention is a device which need not be hand-held whilst providing an extended length of drip catching capability when in use.

Still another advantage of the present invention is a trough-like drip catching apparatus which is flexible in nature so as to facilitate the ease of installation and removal on a vertical surface.

Yet another advantage of the present invention is a compartmentalized longitudinal trough, thereby limiting the ability of the material captured therein to spread along the entire length of the trough, thus creating a more extensive clean-up problem and a handling problem which is heightened due to the captured material tipping the trough when moving the trough from place to place.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A coating and staining material collecting device for removable attachment to a vertical surface comprising an elongated trough, a pair of caps, one of said pair of caps fixedly secured at each free end of said elongated trough, at least one gusset, said at least one gusset fixedly secured to the interior surfaces of said trough dividing said trough into at least two separate open mouth containers, fastening means for fastening said trough to said vertical surface, said trough possessing semi-flexible properties along the longitudinal axis thereof said open mouths of said containers having a straight line marginal edge adjacent a vertically disposed marginal edge of said trough, said open mouths being disposed upwardly, said fastening means comprising a plurality of upwardly extending tapered tabs fixedly secured at the intersection of said vertical edge and said open mouthed portion, said plurality of tapered tabs being disposed in spaced apart relationship along said longitudinal axis, each of said plurality of tapered tabs having a hole located in the lateral surfaces thereof, and the narrowest portion of said each of said plurality of tapered tabs being disposed upwardly and parallel to said longitudinal axis and said intersection whereby said device is adapted to be attached through said holes or by frictional hold of said tabs inserted beneath a shingle comprising said vertical surface.

2. The coating and staining material collecting device as claimed in claim 1 wherein said fastening means additionally comprises a plurality of hook-like elements fixedly secured at one end thereof to the interior surface of said trough adjacent the intersection of said vertical edge and said open-mouthed portion, said plurality of said hook-like elements being disposed in spaced apart relationship along said longitudinal axis, the other end of each of said plurality of hook-like elements describing an inverted U-shaped arc, the plane described by said inverted U-shaped arc lying parallel to the plane defined by said vertical surface when said trough is removably installed thereon.

3. The coating and staining material collecting device as claimed in claim 1 wherein said tapered tabs being fabricated from aluminum.

4. The coating and staining material collecting device as claimed in claim 2 wherein each of said plurality of rod-like elements being fabricated from a wire-like metallic material.

5. The coating and staining material collecting device as claimed in claim 1 wherein said open mouth has a width equal to three inches.

* * * * *